US005549047A

United States Patent [19]

Borgni

[11] Patent Number: 5,549,047

[45] Date of Patent: Aug. 27, 1996

[54] SUBMUNITION FUSE WITH A NONDELAY SELF-DESTRUCT FIRING DEVICE

[75] Inventor: Roberto Borgni, Cornaredo, Italy

[73] Assignee: Simmel Difesa S.p.A., Castelfranco Veneto, Italy

[21] Appl. No.: 435,498

[22] Filed: May 5, 1995

[30] Foreign Application Priority Data

May 6, 1994 [IT] Italy ..... TO94A0366

[51] Int. Cl.[6] ..... F42C 15/23; F42C 15/184

[52] U.S. Cl. ..... 102/256; 102/258

[58] Field of Search ..... 102/237, 238, 102/239, 240, 242, 244, 245, 246, 256, 260, 267, 272, 254, 258

[56] References Cited

U.S. PATENT DOCUMENTS

| | | | |
|---|---|---|---|
| 2,701,527 | 2/1955 | Granath et al. | 102/242 |
| 2,871,788 | 2/1959 | Gruerne | 102/239 |

FOREIGN PATENT DOCUMENTS

| | | | |
|---|---|---|---|
| 1121378 | 8/1956 | France | 102/239 |
| 663277 | 11/1987 | Switzerland | 102/272 |

*Primary Examiner*—Stephen M. Johnson
*Attorney, Agent, or Firm*—Ladas & Parry

[57] ABSTRACT

A submunition fuse presenting a tubular body; a support housed in sliding manner in the tubular body; a firing element housed in sliding manner in the support; a detonating element mounted facing the firing element in the armed position of the fuse; a strip fitted to the top of the support, projecting from the tubular body, and which, during descent of the fuse, exerts aerodynamic force on the support in a direction away from the detonating element; a first thrust spring acting on the support to generate a first thrust, in the direction of the detonating element, not exceeding the aerodynamic force; a second thrust spring acting on the firing element to generate a second thrust in the direction of the detonating element; and lock balls retained by the tubular body in such a position as to interfere with and lock the firing element in a withdrawn position. The first thrust spring is disabled, during descent, by the aerodynamic force to maintain the fuse in the arming position, and is activated at the end of descent in the event of failure of the impact-initiating system, by virtue of no longer being counteracted by the aerodynamic force. The support is therefore pushed into such a position as to release the balls and hence the firing element which is pushed by the second spring against the detonating element.

14 Claims, 3 Drawing Sheets

SUBMUNITION FUSE WITH A NONDELAY SELF-DESTRUCT FIRING DEVICE

BACKGROUND OF THE INVENTION

The present invention relates to a submunition fuse with a nondelay self-destruct firing device.

As is known, use has been made for many years of artillery projectiles and rockets containing a number of submunitions or bombs, and a time fuse which, when activated at a given height over the target, bursts the so-called carrier or cargo projectile or rocket to fire the bombs over a given surface area.

The submunitions feature respective fuses by which they are exploded on impact at the end of their fall.

At present, the most commonly used fuses operate solely on impact, and present the drawback of possibly misfiring on impact with soft ground and/or at a small angle of descent, thus resulting in submunitions with "armed" fuses, i.e. with an aligned explosive train, and which may still explode, being left lying on the ground.

To overcome the above drawback, fuses have been devised which, in addition to the primary impact operating mode, also present a secondary self-destruct mode. In this case, when the fuse is armed or the carrier burst, a time mechanism is activated to ensure operation of the fuse in the event it misfires on impact; and, as the submunition, for it to be effective, must of course explode after reaching the target, a lapse of several seconds must be allowed between activation and operation of the self-destruct mechanism.

As of yet, two types of self-destruct mechanisms—delayed-explosion and electronic-delay—have been used or proposed, neither of which, however, has proved altogether satisfactory. The delayed-explosion type, in fact, presents the disadvantage of being sensitive to ageing and storage conditions; while the electronic-delay type features electronic components, is also affected by prolonged storage and storage conditions if battery powered, and is of complex, high-cost design if powered by electromagnetic generators exploiting relative rotation of the firing pin and fuse.

SUMMARY OF THE INVENTION

It is an object of the present invention to provide a submunition fuse designed to overcome the aforementioned drawbacks, and which is therefore reliable, low-cost, and, in particular, is extremely compact and capable of operating reliably within a wide temperature range and even after many years' storage.

According to the present invention, there is provided a submunition fuse with a nondelay, self-destruct firing device, comprising a tubular arming body; a support housed in sliding manner in said tubular arming body; a firing element supported in sliding manner in said support; a detonating assembly mounted facing said firing element, at least in the armed position of said firing element; and vertical-force generating means for generating, during descent of said fuse, a vertical force acting on said support in a direction away from said detonating assembly; characterized in that it comprises first thrust means acting on said support and for generating a first thrust, in the direction of said detonating assembly, of a value not exceeding said vertical force; second thrust means acting on said firing element and for generating on said firing element a second thrust in the direction of said detonating assembly; and lock means acting on said firing element and for locking said firing element in a withdrawn arming position; said lock means being disabled by said first thrust means in the absence of said vertical force.

BRIEF DESCRIPTION OF THE DRAWINGS

Two preferred, non-limiting embodiments of the present invention will be described by way of example with reference to the accompanying drawings, in which.

DETAILED DESCRIPTION OF THE INVENTION

Figure 1:
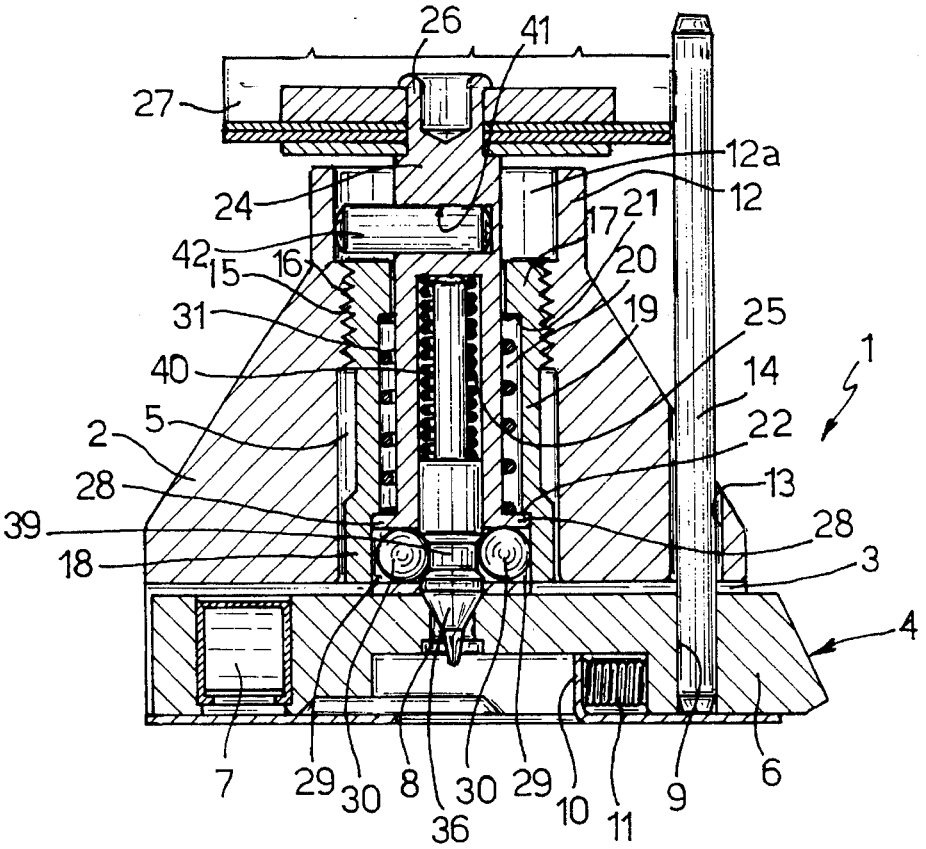
FIGS. 1 to 4 show cross sections of a first embodiment of the fuse according to the present invention, at four different stages.

With reference to FIGS. 1 to 4, the fuse according to the invention is indicated as a whole by 1, and comprises a casing 2 presenting a transverse bottom channel 3 housing a detonating assembly 4, and an axial channel 5 perpendicular to and communicating with transverse channel 3.

Detonating assembly 4 comprises a slide 6 supporting a capsule 7 and presenting two transverse holes 8, 9; and, between slide 6 and a stop 10 integral with casing 2, there is interposed a compressed coil spring 11 for pushing slide 6 outwards of transverse channel 3 (to the right in the drawings).

Casing 2 also presents an annular extension 12 (forming an axial chamber 12*a*) at the top; and a peripheral through hole 13 which, in the withdrawn position of slide 6 (shown in FIG. 1 and corresponding to the unarmed position of fuse 1), is aligned with hole 9 and houses a safety pin 14.

At the top, axial channel 5 of casing 2 presents a thread 15 which, in the unarmed position of fuse 1 (FIG. 1), engages an externally threaded upper portion 16 of a bush 17 housed inside axial channel 5. At the bottom, bush 17 presents a wider portion 18 separated from threaded portion 16 by a smaller-diameter intermediate portion 19, so that, when threaded portion 16 is detached from thread 15, bush 17 is permitted to move in relation to container 2 but not to withdraw fully from axial channel 5.

Bush 17 presents an axial hole 20 in turn presenting a minimum diameter at its top end, a medium diameter over most of its length, and a maximum diameter at the bottom end (at wider portion 18 of bush 17), so as to form two stop shoulders 21, 22. A firing pin support or holder 23 is housed inside axial hole 20 so as to slide but not to rotate in relation to bush 17, which rotation lock may be achieved, for example, by means of prismatic sections (not shown) at one end of hole 20 and on the facing portion of holder 23, or by means of lock pins (not shown).

Holder 23 is substantially in the form of an upside down cup comprising a closed top end 24, and a dead hole 25 with its open end facing detonating assembly 4. The top end 24 of holder 23 also projects from axial hole 20 in the safe (unarmed) position of fuse 1, and is fixed—in the example shown, by riveting—at 26 to a known strip 27 for arming fuse 1.

The bottom end 28 of holder 23 is flared, and presents two or more radial chambers 29, each housing a ball 30. Between shoulder 21 and the flared end 28 of holder 23, axial hole 20 houses a compression spring 31 defining first thrust means for pushing holder 23 towards detonating assembly 4, and the force of which is so calibrated as not to exceed the aerodynamic force to which strip 27 is subjected during descent of the fuse, as described in more detail later on.

Dead hole 25 of holder 23 houses in sliding manner a firing pin 35 comprising a tip 36 projecting from dead hole 25, an intermediate lock portion 37, and a small-diameter rod 38. More specifically, lock portion 37 presents substantially the same diameter as dead hole 25, with the exception of an annular groove 39 which, prior to activation of fuse 1, is engaged by balls 30; and groove 39, balls 30, and hole 20 at the wider portion 18 of bush 17 are so sized that, in the unarmed position and the armed (pre-activation) position of the fuse, the inner wall of bush 17 holds balls 30 against lock portion 37 and inside groove 39, to lock the firing pin 35 in position.

A compression spring 40, fitted about rod 38 inside dead hole 25, acts between the bottom of dead hole 25 and lock portion 37, and defines second thrust means acting on and for pushing firing pin 35 towards detonating assembly 4; which thrust is normally disabled by the locking action of balls 30, with the exception of the self-destruct condition described later on.

Finally, the top end 24 of holder 23 presents a radial hole 41 housing part of a loosely fitted pin 42 projecting inside chamber 12*a* and held in place by annular extension 12, and which provides for maintaining holder 23 integral with bush 17 when this is rotated and unscrewed, and which is expelled automatically when bush 17 is unscrewed by a given amount, as explained later on.

Fuse 1 operates as follows. To begin with, when fuse 1 is unarmed (FIG. 1), slide 6 is in the withdrawn position with hole 9 aligned with hole 13 and safety pin 14 inserted; tip 36 of firing pin 35 is housed inside hole 8 to hold slide 6 in place; and threaded portion 16 of bush 17 engages thread 15 of casing 2.

Following assembly of fuse 1 to the bomb (not shown), removal of safety pin 14, and bursting in known manner of the projectile in flight, strip 27 begins to unwind. At this stage, due to rotation of the bomb about its axis and/or the air brake to which strip 27 is subjected, relative rotation occurs between casing 2 and holder 23, which rotation is transmitted to bush 17 so that threaded portion 16 unscrews from thread 15 of casing 2, and the whole comprising bush 17, holder 23 and firing pin 35 is raised. In the case of bombs with arming strips 27 that take some time to unwind, the drag on the strip at this first stage may not yet be sufficient to counteract the thrust exerted by compression spring 31, so that holder 23 tends to slide downwards in relation to bush 17. This is prevented, however, by pin 42 retained inside radial hole 41 by the annular extension of casing 2.

Pin 42 is expelled by centrifugal force before bush 17 unscrews completely, and upon radial hole 41 passing the top edge of casing 2. At which point, the drag on the arming strip is undoubtedly greater than the force exerted by spring 31, so that no danger of malfunctioning exists and the firing assembly may thus be set to operate.

Figure 2:
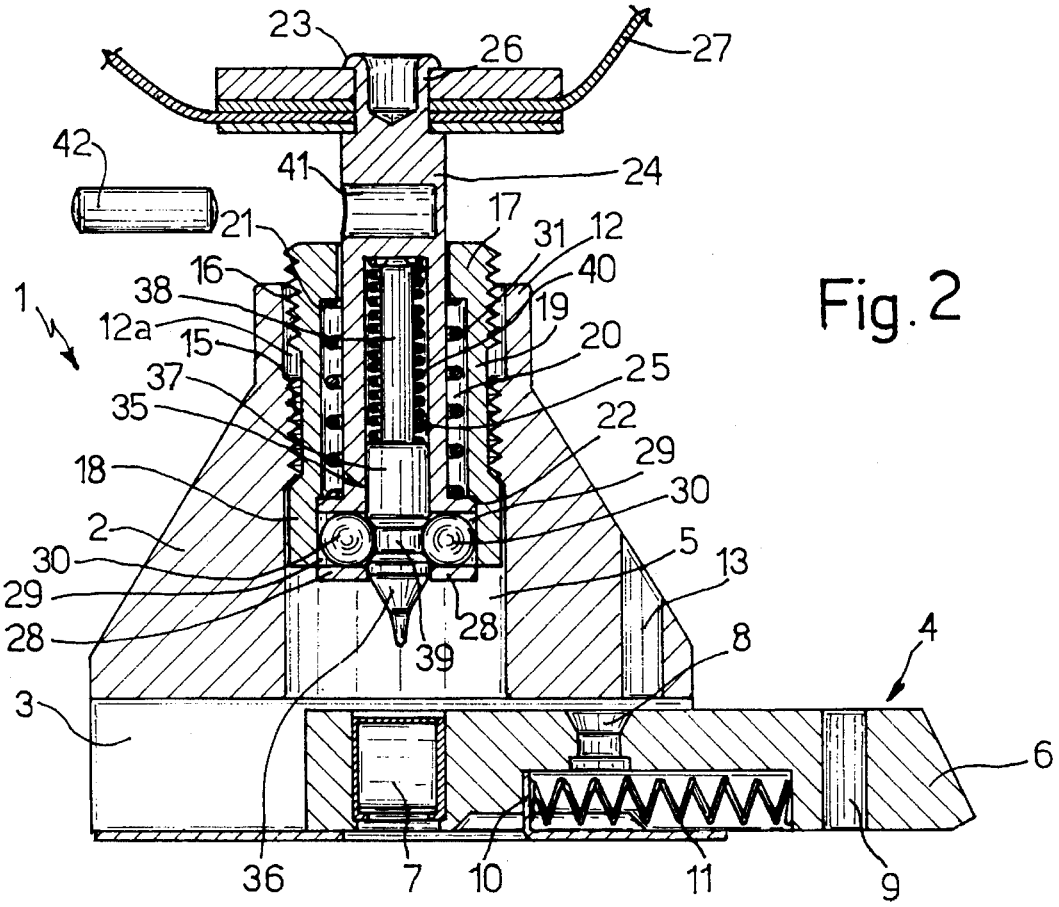
Figure 3:
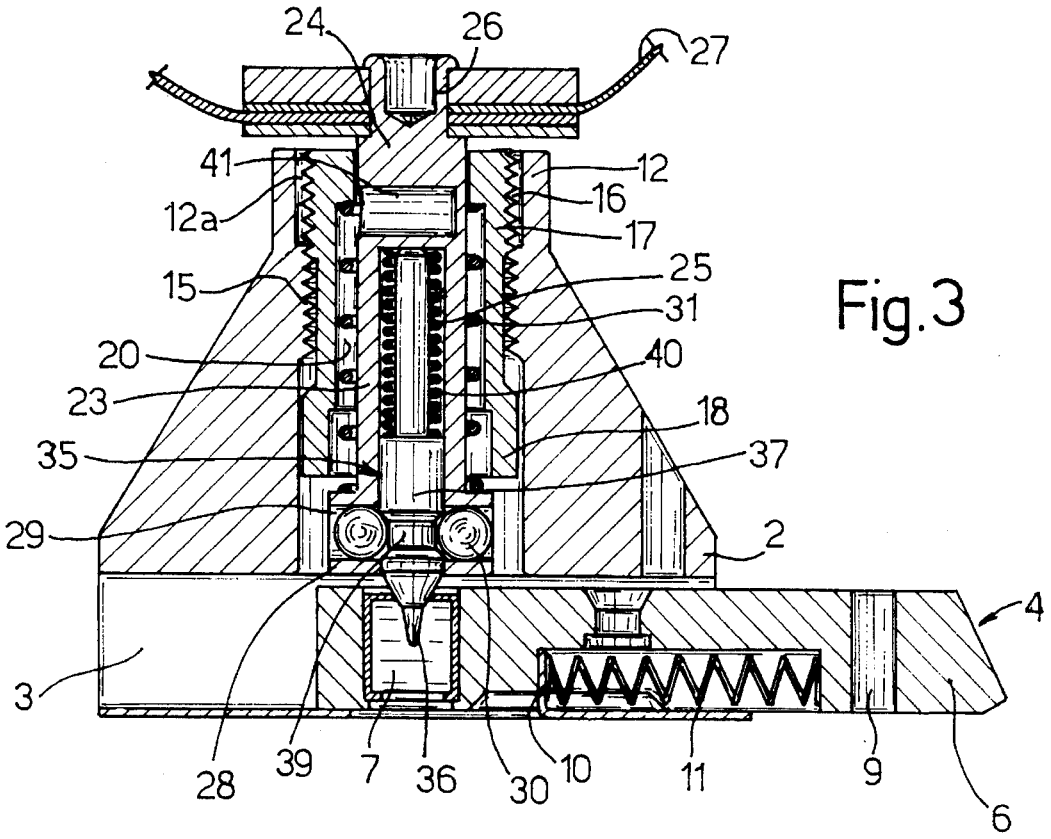
Figure 4:
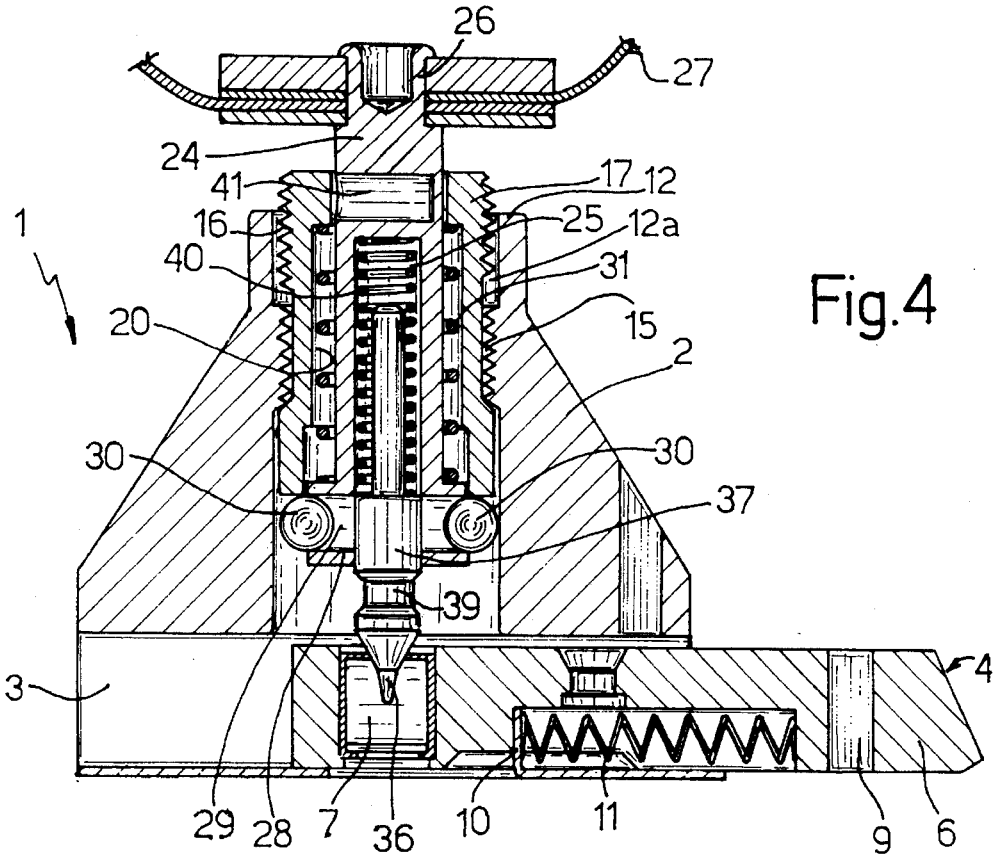

The assembly comprising bush 17, holder 23 and firing pin 35 thus moves into the extracted position with wider portion 18 of bush 17 contacting thread 15; and slide 6, no longer retained by tip 36 of firing pin 35 inside hole 8, is pushed by spring 11 into the extracted position to set capsule 7 beneath firing pin 35, and the fuse to the armed position shown in FIG. 2.

In the case of violent impact (FIG. 3), i.e. with a firm target, holder 23 falls by inertia towards slide 6, taking with it firing pin 35, the tip 36 of which penetrates and initiates capsule 7.

Conversely, in the event of impact with soft ground or such that the kinetic energy accumulated is insufficient to move holder 23 by inertia, the self-destruct mechanism comes into play.

More specifically, when the aerodynamic force exerted on strip 27 during descent is cut off, spring 31 is free to push holder 23 axially downwards; balls 30, no longer retained by the inner wall of hole 20, are pushed radially outwards by firing pin 35 in turn subjected to the action of spring 40; and firing pin 35, which is now free, is pushed by spring 40 against capsule 7 (FIG. 4) to explode the fuse.

Figure 5:
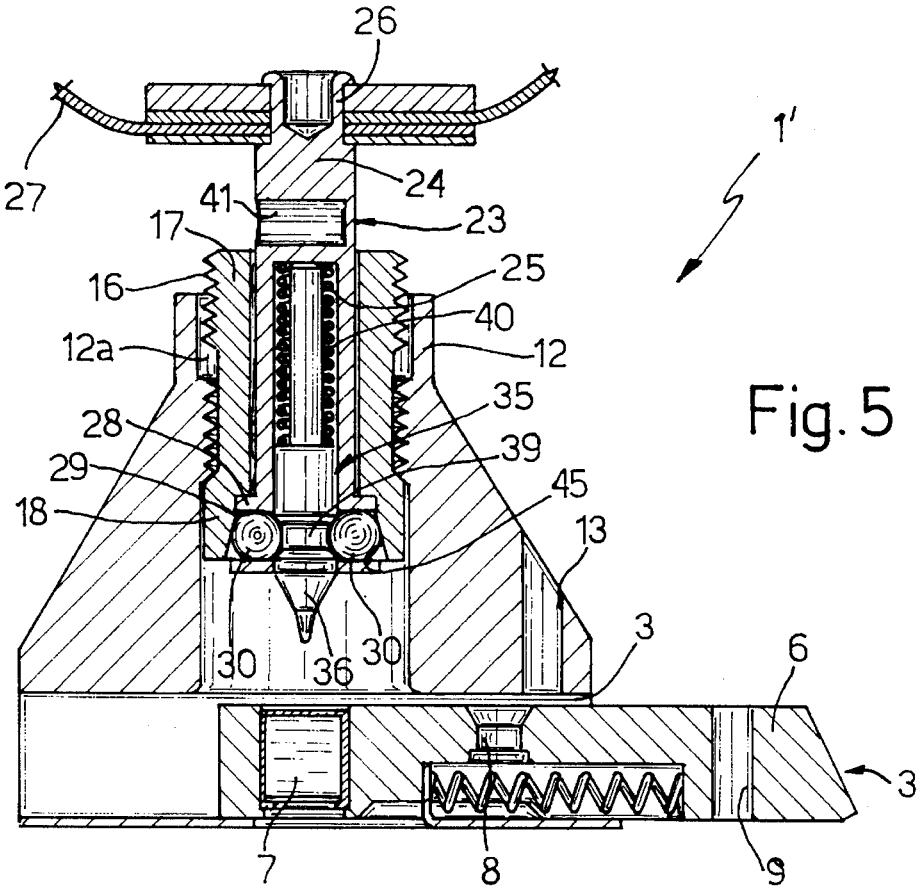
FIGS. 5 and 6 show cross sections of a second embodiment of the fuse according to the present invention, at two different stages corresponding to those of FIGS. 2 and 4.
Figure 6:
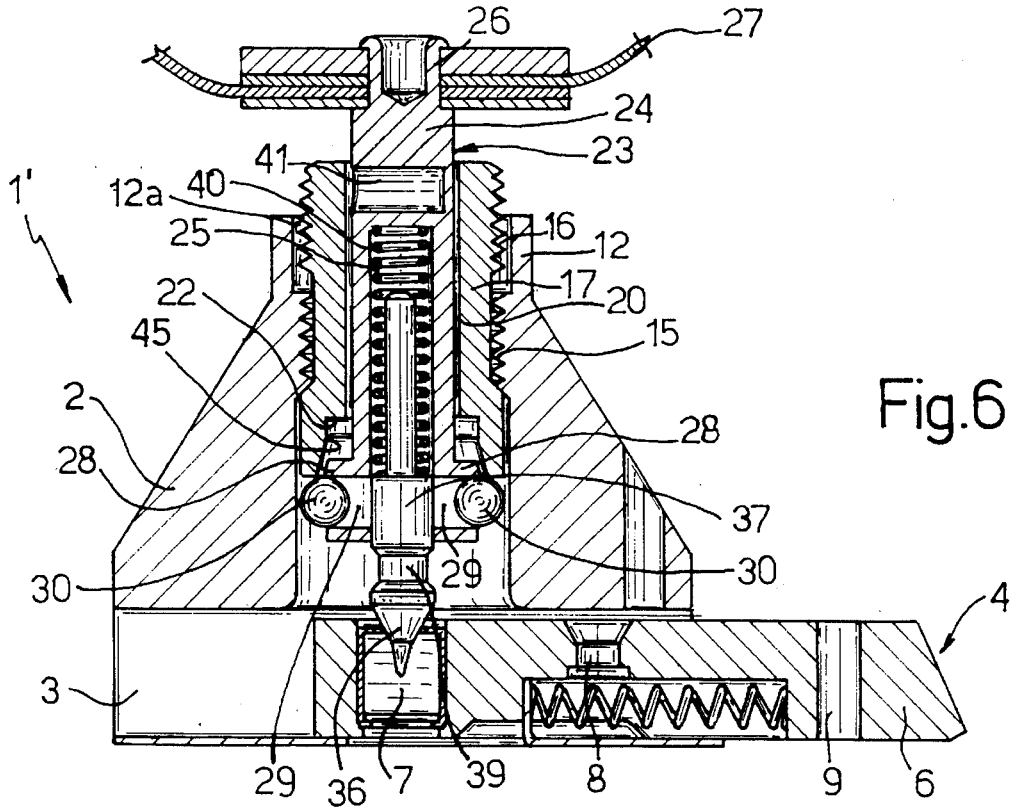

FIGS. 5 and 6 show a variation of the fuse according to the invention, in the unarmed and self-destruct position respectively.

The FIG. 5 and 6 fuse, indicated by 1', presents substantially the same structure as fuse 1 in FIGS. 1 to 4, with the exception of the first thrust means. More specifically, fuse 1' in FIGS. 5 and 6 presents no spring 31, and the downward thrust action on holder 23 is achieved by a conical surface 45 defining the bottom portion of hole 20 at the wider portion 18 of bush 17.

Since spring 31 is eliminated, hole 20 of fuse 1' presents one diameter, with the exception of the bottom portion referred to above, so that shoulder 21 is also eliminated.

The downward thrust action on holder 23 of fuse 1' is achieved by virtue of firing pin 35, via spring 40, subjecting balls 30 to a force presenting a transverse component, i.e. perpendicular to the axial direction of casing 2, which pushes balls 30 against conical surface 45; conical surface 45 thus subjects balls 30 to a reaction force presenting a downward axial component which is transmitted by balls 30 to radial projections 28 and from there to holder 23 in the same way as spring 31 in the first embodiment. During descent, the downward thrust on holder 23 is compensated and eliminated by the drag on strip 27 and, initially if necessary, by pin 42 as in the previous example. During descent, fuse 1', when armed, is positioned as shown in FIG. 5.

In the event of violent impact, the assembly comprising holder 23 and firing pin 35 moves axially downwards, by virtue of the kinetic energy accumulated and in exactly the same way as for fuse 1, to initiate capsule 7.

Conversely, in the event of soft impact or at any rate not strong enough to initiate the capsule, the thrust exerted by conical surface 45 on holder 23, and no longer counteracted by aerodynamic force, slides holder 23 downwards so that radial chambers 29 come out of axial hole 20; balls 30, due to the radial thrust exerted by firing pin 35 via spring 40, release groove 39 on the firing pin; and firing pin 35, which is now free, is pushed by spring 40 against capsule 7 to initiate it and so self-destruct the fuse.

The fuses described therefore present a self-destruct mechanism which is activated independently of descent time and immediately after impact in the event of failure of the primary initiating system, with no need for predetermined-delay mechanisms, and hence with no risk of the self-destruct mechanism coming into play too soon or too late.

Moreover, the solutions described are unaffected by ageing or storage conditions, are straightforward in design, and are comparable costwise with known impact-only solutions.

Clearly, changes may be made to the fuses as described and illustrated herein without, however, departing from the scope of the present invention. In particular, if the fuse is applied to bombs which, by design or descent characteristics, present considerable drag from the outset, pin 42 may be dispensed with.

I claim:

1. A submunition fuse for detonating a firing device after a descent from an altitude, the fuse comprising:

a) a detonating element;

b) a tubular arming body;

c) a support housed in said tubular body and slidable in said body between an armed position proximal to the detonating element and an unarmed position further from the detonating element;

d) a firing element housed in said support and slidable between a disabled position and an enabled position wherein the firing element can trigger the detonating element;

e) air brake means on said support for causing ambient atmosphere to exert a retarding force on said support during said descent, with said retarding force acting in a direction away from the detonating element, whereby the air brake means biases said support toward said unarmed position during said descent;

f) first thrust means acting on said support for generating a first thrust, in a direction toward the detonating element, of a value not exceeding said retarding force whereby to urge said support to slide in the tubular body from said unarmed position to said armed position only in an absence of the retarding force;

g) lock means for preventing the firing element from sliding from said disabled position to said enabled position if and only if said support is in said unarmed position; and h) second thrust means for generating on said firing element a second thrust in a direction toward said detonating element to urge the firing element to slide toward said enabled position if not prevented by the lock means.

2. A fuse as claimed in claim 1, wherein said lock means comprises at least one locking body which, in said armed position, is locked in a position to interfere with said firing element.

3. A fuse as claimed in claim 2, wherein said locking body comprises at least one ball.

4. A fuse as claimed in claim 2, wherein said firing element comprises a grooved element engaging said locking body in said unarmed and armed positions.

5. A fuse according to claim 2, wherein said support comprises at least one radial chamber housing said locking body, said chamber being internally delimited by said firing element; and wherein said support is movable with respect to said tubular body between the disabled position wherein said radial chamber is externally delimited by a portion of said tubular body and the enabled position wherein said radial chamber is externally open and permits radial movement of said locking body.

6. A fuse as claimed in claim 1, wherein said second thrust means comprises a first elastic element.

7. A fuse as claimed in claim 6, wherein said support is cup-shaped and presents a dead hole open towards said detonating element and housing at least one portion of said firing element; said first elastic element being interposed between the bottom surface of said dead hole and a mating surface of said firing element.

8. A fuse as claimed in claim 1, wherein said first thrust means comprises a second elastic element interposed between said tubular body and said support.

9. A fuse as claimed in claim 1, wherein said first thrust means comprises an inclined surface formed inside said tubular body and acting on said locking body in said unarmed and armed positions.

10. A fuse as claimed in claim 1, wherein said air brake means comprises an air brake element.

11. A fuse as claimed in claim 10, wherein said air brake means also comprises a stop element fitted removably to said support and cooperating with said tubular body to prevent said support from sliding in relation to said tubular body when arming said fuse.

12. A fuse as claimed in claim 11, wherein said stop element comprises a pin housed loosely in and projecting from a cavity in said support; said fuse also comprising a casing housing said tubular body and a portion for retaining said pin in said cavity when arming said fuse.

13. In a projectile comprising a carrier containing a plurality of submunitions and a timing fuse, wherein the timing fuse, when activated at an altitude over a target, bursts the carrier to release the plurality of submunitions and wherein each of the plurality of submunitions comprises a firing device and a submunition fuse for detonating the firing device after a descent from the altitude, the improvement wherein the submunition fuse comprises:

a) a detonating element;

b) a tubular arming body;

c) a support housed in said tubular body and slidable in said body between an armed position proximal to the detonating element and an unarmed position further from the detonating element;

d) a firing element housed in said support and slidable between a disabled position and an enabled position wherein the firing element can trigger the detonating element;

e) air brake means on said support for causing ambient atmosphere to exert a retarding force on said support during said descent, with said retarding force acting in a direction away from the detonating element, whereby the air brake means biases said support toward said unarmed position during said descent;

f) first thrust means acting on said support for generating a first thrust, in a direction toward the detonating element, of a value not exceeding said retarding force whereby to urge said support to slide in the tubular body from said unarmed position to said armed position only in an absence of the retarding force;

g) lock means for preventing the firing element from sliding from said disabled position to said enabled position if and only if said support is in said unarmed position; and h) second thrust means for generating on said firing element a second thrust in a direction toward said detonating element to urge the firing element to slide toward said enabled position if not prevented by the lock means.

14. A projectile according to claim 13, wherein said support comprises at least one radial chamber housing said locking body, said chamber being internally delimited by said firing element; and wherein said support is movable with respect to said tubular body between the disabled position wherein said radial chamber is externally delimited by a portion of said tubular body and the enabled position wherein said radial chamber is externally open and permits radial movement of said locking body.

* * * * *